US011554406B2

(12) United States Patent
Xu et al.

(10) Patent No.: US 11,554,406 B2
(45) Date of Patent: Jan. 17, 2023

(54) HIGH-PRECISION HEAVY-LOAD NUMERICALLY-CONTROLLED FLANGING MACHINE

(71) Applicants: NANJING UNIVERSITY OF POSTS AND TELECOMMUNICATIONS, Nanjing (CN); NANJNG NANYOU INSTITUTE OF INFORMATION TECHNOVATION CO., LTD, Nanjing (CN)

(72) Inventors: Fengyu Xu, Nanjing (CN); Baojie Fan, Nanjing (CN); Sen Yang, Nanjing (CN); Kaiwei Ma, Nanjing (CN); Guoping Jiang, Nanjing (CN)

(73) Assignee: NANJING UNIVERSITY OF POSTS AND TELECOMMUNICATIONS, Nanjing (CN)

( * ) Notice: Subject to any disclaimer, the term of this patent is extended or adjusted under 35 U.S.C. 154(b) by 101 days.

(21) Appl. No.: 17/334,996

(22) Filed: May 31, 2021

(65) Prior Publication Data

US 2021/0283674 A1 Sep. 16, 2021

(51) Int. Cl.
*B21D 39/02* (2006.01)
*B21D 5/00* (2006.01)

(52) U.S. Cl.
CPC ..... *B21D 39/02* (2013.01); *B21D 5/004* (2013.01)

(58) Field of Classification Search
CPC ..... B30B 1/26; B30B 1/266; B21D 19/08; B21D 19/082; B21D 5/04; B21D 5/045
USPC ..... 72/319–323, 452.8, 452.5, 452.9; 74/49
See application file for complete search history.

(56) References Cited

U.S. PATENT DOCUMENTS

| | | | | |
|---|---|---|---|---|
| 3,543,558 | A * | 12/1970 | Currier | B21D 53/00 72/308 |
| 3,662,584 | A * | 5/1972 | Jones, Jr. | B21D 19/08 72/321 |
| 10,773,393 | B2 * | 9/2020 | Xu | B25J 9/046 |
| 2017/0333974 | A1 * | 11/2017 | Sonntag | B21D 19/08 |
| 2020/0353521 | A1 * | 11/2020 | Long | B21D 43/027 |

* cited by examiner

*Primary Examiner* — Adam J Eiseman
*Assistant Examiner* — Bobby Yeonjin Kim
(74) *Attorney, Agent, or Firm* — CBM Patent Consulting, LLC

(57) ABSTRACT

A high-precision heavy-load numerically-controlled flanging machine comprises a machine frame, an edge pressing assembly, a flanging beam and a flanging beam transmission mechanism that comprises an inclined slide rail, an inertia block and two crank-connecting rod mechanisms; the flanging beam is provided with a driving inclined plane; the inclined slide rail is mounted on the machine frame; the inertia block is provided with two non-parallel inclined planes, wherein one inclined plane of the inertia block is slidably mounted on the inclined slide rail to form a sliding pair I, and the other inclined plane of the inertia block is in sliding fit with the driving inclined plane of the flanging beam to form a sliding pair II; cranks of the two crank-connecting rod mechanisms are hinged on the machine frame.

9 Claims, 10 Drawing Sheets

HIGH-PRECISION HEAVY-LOAD NUMERICALLY-CONTROLLED FLANGING MACHINE

This application claims priority to Chinese Patent Application Ser. No. 202010717127.0 filed on 27 Jul. 2020.

TECHNICAL FIELD

The present invention relates to the field of metal plate processing, in particular to a high-precision heavy-load numerically-controlled flanging machine.

BACKGROUND

In the field of industrial production, the mental plate accounts for a very high proportion. For example, in the automobile industry, the metal plate forming and processing accounts for about 60%; in the white household industry, the metal plate processing accounts for about 80%; in the industries such as electric appliance cabinets, express delivery cabinets, cupboards and file cabinets, the metal plate processing accounts for more than 95%.

In recent years, the numerically-controlled metal plate processing equipment is developing in an approach towards automation, intelligence, high speed, high precision and heavy load. In the metal plate forming and processing industry, the metal plate bending is a process with the largest difficulty in techniques and automation. The overall technical level of the bending processing of plates determines the technical level of the whole field of metal plate processing.

The conventional metal plate bending is a "three-point" bending process, and the principle of which is shown in FIG. 12. In this processing, the metal plate will overturn upward upon bending, which will affect the processing precision, pose a threat on the personal safety of operators, and increase the labor intensity.

To solve this problem, there are two solutions:

1. A supplementary material-supporting mechanism, such as, a bending follow-up material-supporting device (Application No. 201810934350.3), and a synchronous follow-up material-supporting device of a numerically-controlled bending machine (Application No. 201010194128.8), is adopted.

2. A supplementary bending robot, such as, a metal plate bending robot with additional seven axes (Application No. 201820081641.8) and a follow-up bending control method of a metal plate processing robot (Application No. 201811527563.0), is adopted.

The above two solutions can indeed improve the processing precision to a certain extent, reduce the labor intensity, and improve the operational safety. However, in the solution 1, a semi-automatic mode is adopted with required manual participation, so that the production efficiency is low; in the solution 2, the robot is expensive and covers a large area, the follow-up of the robot is not consistent with the bending of the flanging machine, so that the precision is influenced, and meanwhile, the robot is required to perform multiple operations, such as transporting, overturning and positioning, on the plate during work, so that the processing efficiency is seriously influenced.

Therefore, a bending processing technology and equipment adopting a "flanging" process are developed for heavy-load segments such as engineering machinery, shipbuilding and lamp posts, and certainly can also be applied to segments such as electric appliance cabinets and cupboards, as shown in FIG. 13.

The Chinese Patent Application No. CN201610497320.1 discloses a flanging mechanism of a metal plate flanging machine, comprising a machine frame, wherein a supporting table is arranged at the lower end of the front side of the machine frame, a pressing beam is arranged above the supporting table, a flanging beam is arranged in the front side of the machine frame, a vertical driving mechanism for driving the flanging beam to swing up-and-down is arranged at the left and right sides of the lower end of the flanging beam, and a horizontal driving mechanism for driving the flanging beam to swing back and forth is arranged at the rear end of the flanging beam. The vertical driving mechanism drives the flanging beam to swing up-and-down to realize the movement in the vertical direction, the horizontal driving mechanism drives the flanging beam to swing back-and-forth to realize the movement in the horizontal direction, and the linkage of the two can produce complicated flanging orbits to satisfy different customers' demand.

However, the above patent application has the following disadvantages in use, which needs to be further improved.

1. The horizontal driving mechanism has additional swing while moving in the horizontal direction, and the vertical driving mechanism has additional swing while driving the movement in the vertical direction, so that a single translation with two degrees of freedom in X and Y directions cannot be realized in absolute sense. Therefore, the tool nose orbit cannot be controlled precisely, and the control precision is poor; the angle can be corrected in the bending process only through repeated manual input of correction parameters, rather than through the automatic and precise mathematical calculation on the correction value, and the efficiency is low, so that the bending angle is difficult to control intelligently. In addition, the indentation left on the plate surface in the bending process is inevitable due to the poor precision of the tool nose orbit.

2. The processing precision of the equipment depends on the processing and assembling precision of each hinge point. Therefore, it is difficult to perform processing and manufacturing to realize mass production, which limits the large-scale popularization of the equipment. In addition, in CN201610497320.1, the hinge points are not only configured for driving, but also for guiding the flanging beam or limiting the degree of freedom. Therefore, the parallelism of the flanging beam in the horizontal direction and the vertical direction may be influenced during the movement due to the manufacturing error of the hinge points.

3. Due to the existence of additional swing, the movement position of the flanging beam is difficult to feed back in real time (there is nowhere to mount a feedback measuring sensor), the movement position of the flanging beam is difficult to feed back and control in a closed loop, and thus the processing precision is difficult to guarantee.

4. The abrasion of the hinge points, the elastic deformation of rods of the mechanism and the temperature deformation of components will have a great effect on the processing precision.

SUMMARY

The technical problem to be solved by the present invention is to provide a high-precision heavy-load numerically-controlled flanging machine, aiming at the defects of the prior art. The high-precision heavy-load numerically-controlled flanging machine can realize a translation in the horizontal and vertical directions without additional swing, has high control precision of a tool nose orbit and produce smooth and clean plate surface without indentations in the bending process. Meanwhile, the rigidity of the bending die is high, and the load of the sliding pairs are small; heavy-load large-tonnage bending can be realized; the tool nose orbit can be controlled precisely, and the control precision is high; the angle can be corrected in the bending process through the automatic and precise mathematical calculation on the correction value, and the efficiency is high, so that the bending angle can be controlled intelligently.

In order to solve the above technical problem of the prior art, the present invention provides the following technical solution.

A high-precision heavy-load numerically-controlled flanging machine comprises a machine frame, an edge pressing assembly, a flanging beam, a flanging beam driving mechanism and a flanging die, wherein the edge pressing assembly is configured for pressing the edge of a plate, the flanging die is mounted on the flanging beam, and the flanging beam is driven by the flanging beam driving mechanism to move up-and-down and left-and-right; the flanging beam driving mechanism comprises an inclined slide rail, an inertia block and two crank-connecting rod mechanisms;

the flanging beam is provided with a driving inclined plane;

the inclined slide rail is obliquely mounted on the machine frame;

the inertia block is provided with two non-parallel inclined planes, wherein one inclined plane of the inertia block is slidably mounted on the inclined slide rail to form a sliding pair I, and the other inclined plane of the inertia block is in sliding fit with the driving inclined plane of the flanging beam to form a sliding pair II;

cranks of the two crank-connecting rod mechanisms are hinged on the machine frame, wherein a connecting rod of one crank-connecting rod mechanism is hinged with the flanging beam or the inertia block, and a connecting rod of the other crank-connecting rod mechanism is hinged with the flanging beam.

The high-precision heavy-load numerically-controlled flanging machine further comprises a flanging die displacement detection mechanism configured for detecting the coordinates of the flanging die.

The flanging die displacement detection mechanism is a grating ruler comprising a scale grating, a reading head and a displacement connecting rod; wherein the scale grating is mounted on the machine frame or the flanging beam, the reading head is slidably connected in the scale grating, and the displacement connecting rod is configured for connecting the reading head with the flanging beam or connecting the reading head with the machine frame.

Two groups of the grating rulers are provided, and the movement displacement of the flanging beam in the horizontal direction and the vertical direction is fed back indirectly through the synthesis and operation of readings of the two groups of the grating rulers.

The inertia block is L-shaped, triangular, trapezoidal, quadrilateral or wedge-shaped.

The flanging beam comprises a C-shaped notch and a horizontal beam; the flanging die is mounted at the opening of the C-shaped notch, one end of the horizontal beam is connected with the C-shaped notch, and the other end of the horizontal beam is provided with the driving inclined plane.

The two crank-connecting rod mechanisms are a crank-connecting rod mechanism I and a crank-connecting rod mechanism II, respectively; wherein the crank-connecting rod mechanism I comprises a crank I and a connecting rod I hinged with each other; the tail end of the crank I is hinged on the machine frame, and the other end of the connecting rod I is hinged with the flanging beam or the inertia block;

the crank-connecting rod mechanism II comprises a crank II and a connecting rod II hinged with each other; the tail end of the crank II is hinged on the machine frame, and the other end of the connecting rod II is hinged with the flanging beam.

The precision and the rigidity of the flanging die can be improved, and the load of the sliding pair I and the sliding pair II can be alleviated by optimizing the inclination angles of two inclined planes of the inertia block, the positions of hinge points, the supporting positions and the connecting rod length of the crank-connecting rod mechanisms.

The included angle between the sliding pair I and a horizontal plane is between −75° and +75; the included angle between the sliding pair II and a vertical plane is between −75° and +75°.

The high-precision heavy-load numerically-controlled flanging machine further comprises a toggle mechanism configured for driving the crank-connecting rod mechanism connected with the inertia block, the toggle mechanism being a third crank-connecting rod mechanism or a lead screw transmission mechanism.

The present invention has the following beneficial effects:

1. Because the driving parts are hinged on the machine frame, the rigidity and the strength are stronger, and the structure is simpler, the present invention can be suitable for bending equipment with larger tonnage. If necessary mechanical performance analysis and optimized design are carried out on the structure, the bending tonnage can even range from 500 tons to 1000 tons, and thus the tonnage application range is larger, which is from very small tonnage to very large tonnage. When the connecting rod I of the crank-connecting rod mechanism I is hinged with the flanging beam, the bending load is directly transmitted to the machine frame through the crank-connecting rod mechanism I, and the sliding pair only needs to bear a very small load (only needs to bear the overturning load caused by the load center not being in a straight line with the hinge center, which is actually much smaller than the bending working load), so that heavy-load large-tonnage bending can be realized, and the requirements of industries such as engineering machinery, shipbuilding and lamp posts on large-tonnage bending can be met.

2. The flanging die and the flanging beam are complete rigid translation in X and Y directions without additional swing, the degree of freedom is simple, the tool nose orbit can be controlled precisely, and the tool nose can roll on the plate without sliding relatively, and thus the indentation on the plate surface is avoided, so that the present invention is suitable for industries, such as household appliances and elevators, which have strict requirements on the indentation on the plate surface.

3. The linear guide rail is adopted for guiding, so that the present invention is small in manufacturing difficulty, high in precision, easy to control the precision, and is durable. The hinge points of the present invention are only configured for driving, and the "guiding, or the function called the limitation of degree of freedom" of the flanging beam is realized by a sliding pair (a guide rail), which has a far better precision than that of a hinged mode and a lower manufacturing difficulty. The present invention is high in bending precision, with the bending angle up to between −0.1° and +0.1°, the bending size precision up to between −0.02 mm and +0.02 mm, and the parallelism up to between −0.05 mm and +0.05 mm.

4. Due to the absence of additional swing, the displacement of the flanging beam can be fed back in real time by adopting a linear displacement feedback measuring device, such as a grating ruler, to form a closed-loop control. By the feedback of the grating ruler, the transmission part error, the temperature deformation and the elastic deformation of the structure can be compensated, and thus the precision is greatly increased.

5. The tool nose orbit can be controlled precisely, and the control precision is high; the angle can be corrected in the bending process through the automatic and precise mathematical calculation on the correction value, and the efficiency is high, so that the bending angle can be controlled intelligently.

6. When the connecting rod of the crank-connecting rod mechanism I is hinged with the flanging beam, the inverse kinematics solution of the flanging beam driving mechanism is simpler, the analytical solution is easier to solve, and the high-speed high-precision control is facilitated.

Figure 1:
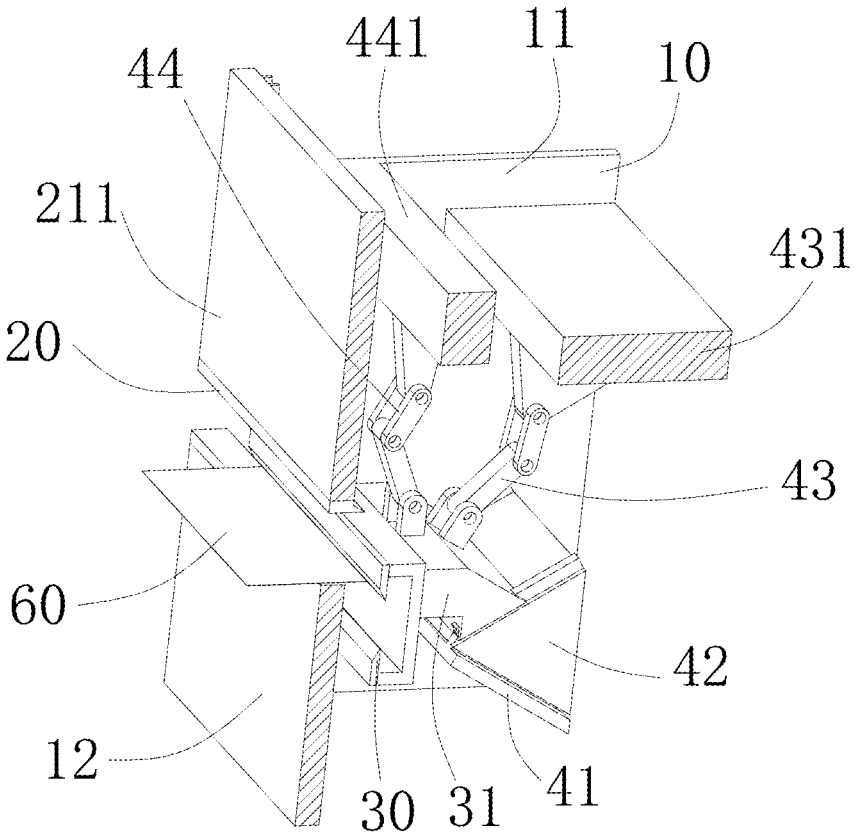
FIG. 1 shows a structural schematic diagram of a first embodiment of a high-precision heavy-load numerically-controlled flanging machine according to the present invention.

10 is a machine frame; 11 is a machine frame side plate; 12 is a plate supporting base;

20 is a bending die; 21 is an upper die; 211 is a lifting slide block; 22 is a lower die;

30 is a flanging die; 31 is a flanging beam; 311 is a C-shaped notch; 312 is a horizontal beam; 313 is a driving inclined plane; 32 is an upper flanging die; 33 is a lower flanging die; 34 is a tool nose; 35 is a tool nose orbit;

41 is an inclined slide rail; 42 is an inertia block; 421 is an upper inclined plane; 422 is a lower inclined plane;

43 is a crank-connecting rod mechanism I; 431 is a fixing base I; 432 is a crank I; 433 is a connecting rod I;

44 is a crank-connecting rod mechanism II; 441 is a fixing base II; 442 is a crank II; 443 is a connecting rod II;

51 is a scale grating I; 52 is a reading head I; 53 is a displacement connecting rod I; 54 is a scale grating II; 55 is a reading head II; 56 is a displacement connecting rod II;

60 is a plate.

DETAILED DESCRIPTION

The present invention will be further described in detail with reference to the drawings and specific preferred embodiments.

In the description of the present invention, it should be understood that the terms "left side", "right side", "upper part", "lower part" and the like refer to orientations or positions based on those shown in the drawings. The terms are only for the convenience and simplification of the description of the present invention, rather than indicating or implying that the device or element referred to must have a specific orientation, be constructed and operated in a specific orientation. The terms "first" and "second" do not represent the importance of components, and therefore cannot be construed as limiting the present invention. The specific dimensions used in the present example are only for illustrating the technical solution without limiting the protection scope of the present invention.

Figure 2:
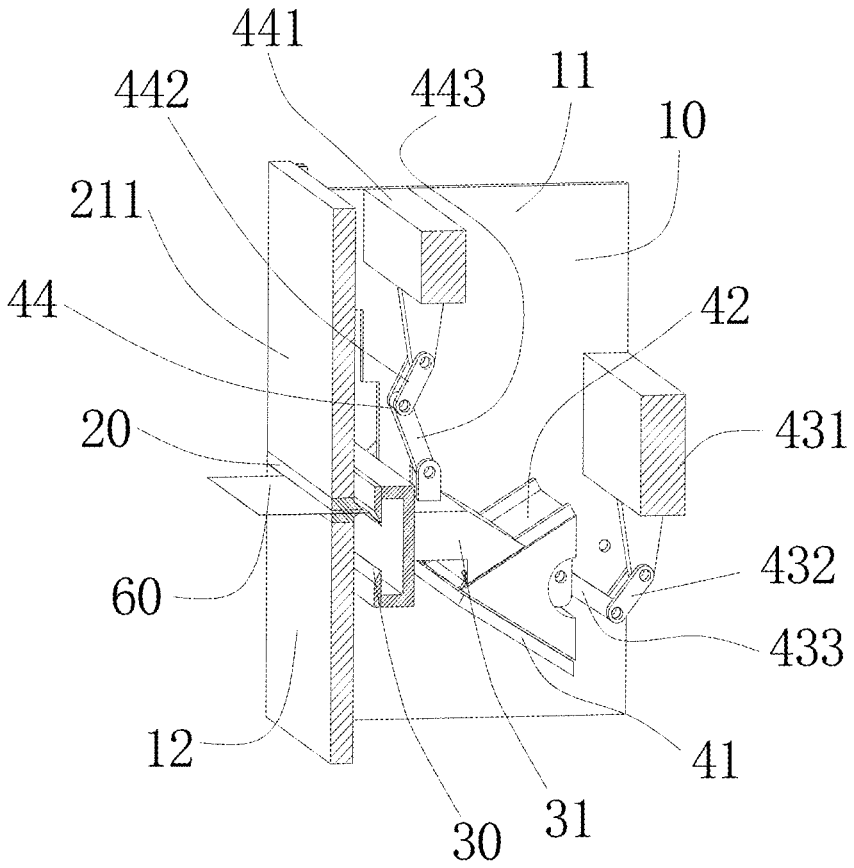
FIG. 2 shows a structural schematic diagram of a second embodiment of a high-precision heavy-load numerically-controlled flanging machine according to the present invention.

As shown in FIGS. 1 and 2, the high-precision heavy-load numerically-controlled flanging machine of the present invention comprises a machine frame 10, an edge pressing assembly, a flanging beam 31, a flanging beam driving mechanism and a flanging die 30.

The machine frame comprises a plate supporting base 12 and two machine frame side plates 11, the two machine frame side plates 11 being positioned on two sides of the plate supporting base.

The edge pressing assembly is configured for pressing the edge of a plate and comprises a lifting slide block 211 and a bending die 20.

The lifting slide block is preferably and slidably mounted at the top ends of the left sides of the two machine frame side plates in FIG. 1, and can be raised and lowered.

The lifting slide block and the machine frame are not limited to slidable mounting, other connection modes, such as swingable mounting, in the prior art are further available, as long as the plate can be pressed.

The bending die comprises an upper die 21 and a lower die 22 arranged oppositely, wherein the upper die is fixed to the lower surface of the lifting slide block, and the lower die is fixed to the upper surface of the left side of the plate supporting seat.

As an alternative, the plate supporting base can be arranged independently, and is not integrated with the machine frame.

As shown in FIG. 3, the flanging die comprises an upper flanging die 32 and a lower flanging die 33 mounted on the flanging beam 31.

The flanging beam comprises a C-shaped notch 311 and a horizontal beam 312.

The flanging die is preferably mounted at the opening of the C-shaped notch, and the upper flanging die 32 and the lower flanging die 33 are mounted on opposite upper and lower sides of the C-shaped notch, respectively.

One end of the horizontal beam is connected with the C-shaped notch, and the other end of the horizontal beam is provided with a driving inclined plane 313.

The flanging beam is driven by the flanging beam driving mechanism to move up-and-down and left-and-right movement.

The flanging beam driving mechanism comprises an inclined slide rail 41, an inertia block 42 and two crank-connecting rod mechanisms.

The inclined slide rail is preferably and obliquely mounted on the machine frame of the numerically-controlled bending equipment adjacent to the flanging die, namely on the upper surface of the plate supporting base adjacent to the lower die. That is to say, an inclined smooth surface is arranged on the upper surface of the plate supporting base adjacent to the lower die as an inclined slide rail. As an organic component of the machine frame, the inclined slide rail has high supporting rigidity, and is suitable for flanging requirements of large-tonnage metal plates.

As shown in FIG. 3, the inertia block is provided with two non-parallel inclined planes, an upper inclined plane 421 and a lower inclined plane 422.

The lower inclined plane is slidably mounted on the inclined slide rail to form a sliding pair I; the upper inclined plane is in sliding fit with the driving inclined plane of the flanging beam to form a sliding pair 11.

In this embodiment, the inertia block is preferably a triangle, more preferably an acute triangle, even more preferably an isosceles acute triangle, and may also be a right triangle.

As an alternative, the inertia block may be in the shape of other polygons such as an L, a trapezoid, a quadrilateral, or a wedge. However, when the inertia block is a trapezoid, the two non-parallel inclined planes are two "waists" of the trapezoid, respectively.

The upper and lower inclined planes 421 and 422 are preferably at an acute angle, but may be at a right angle.

The specific preferred arrangement is as follows: the included angle between the sliding pair I and a horizontal plane is preferably between −75° and +75; the included angle between the sliding pair II and a vertical plane is preferably between −75° and +75°. For example, when the included angle between the sliding pair I and the horizontal plane is 0, the included angle between the sliding pair II and the vertical plane may be any acute angle between 0° or 75°. The special embodiment that the included angle between the sliding pair I and the horizontal plane is 0°, and the included angle between the sliding pair II and the vertical plane is 0° is also included.

The two crank-connecting rod mechanisms have the following two preferred embodiments, and thus the high-precision heavy-load numerically-controlled flanging machine of the present invention also has the following two preferred embodiments.

Embodiment 1

The two crank-connecting rod mechanisms are a crank-connecting rod mechanism I 43 and a crank-connecting rod mechanism 1144, respectively.

The crank-connecting rod mechanism I comprises a crank I 432 and a connecting rod II 433 hinged with each other.

The tail end of the crank I is preferably hinged on the machine frame through a fixing seat I 431.

Figure 3A:
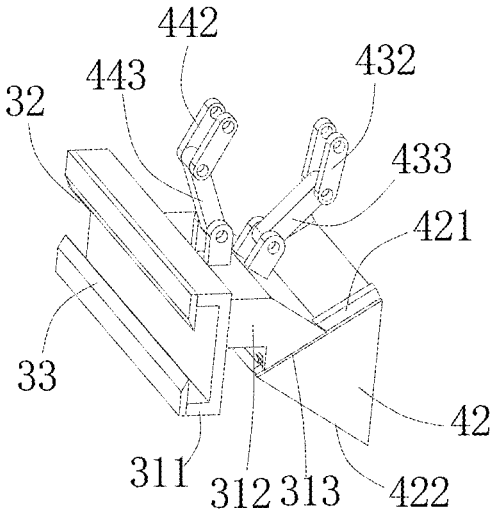
FIG. 3*a* shows a structural schematic diagram of a flanging beam and an inertia block, wherein shows an enlarged diagram of the flanging beam and the inertia block of FIG. 1.

One end of the connecting rod I is hinged with the crank I, and the other end of the connecting rod I is hinged with the flanging beam, as shown in FIGS. 1 and 3*a*.

When the connecting rod I of the crank-connecting rod mechanism I is hinged with the flanging beam, the bending load is directly transmitted to the machine frame through the crank-connecting rod mechanism I, and the sliding pair only needs to bear a very small load (only needs to bear the overturning load caused by the load center not being in a straight line with the hinge center, which is actually much smaller than the bending working load), so that heavy-load large-tonnage bending can be realized.

Figure 4A:
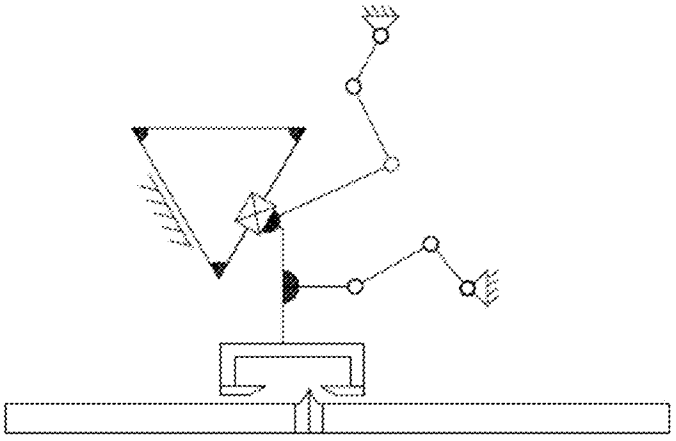
FIG. 4*a* shows a functional diagram of a high-precision heavy-load numerically-controlled flanging machine according to the present invention, a functional diagram of the first embodiment.

When the connecting rod of the crank-connecting rod mechanism I is hinged with the flanging beam, the inverse kinematics solution of the flanging beam driving mechanism is simpler, the analytical solution is easier to solve, and the heavy-load high-precision control is facilitated. The working principle is shown in FIG. 4*a*.

Embodiment 2

Figure 3B:
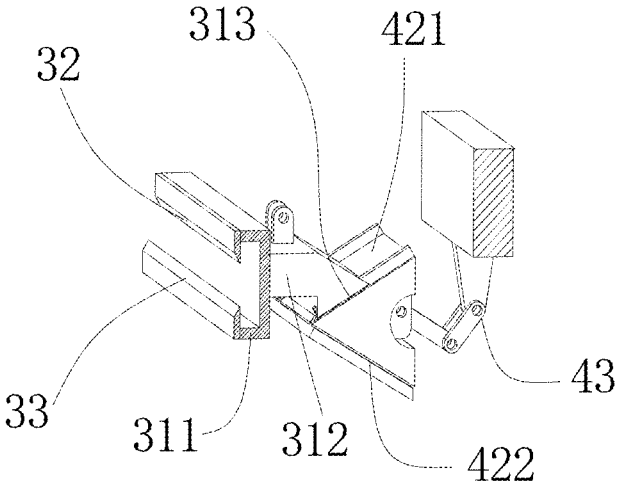
FIG. 3*b* shows a structural schematic diagram of a flanging beam and an inertia block, wherein shows an enlarged diagram of the flanging beam and the inertia block of FIG. 2.
Figure 4B:
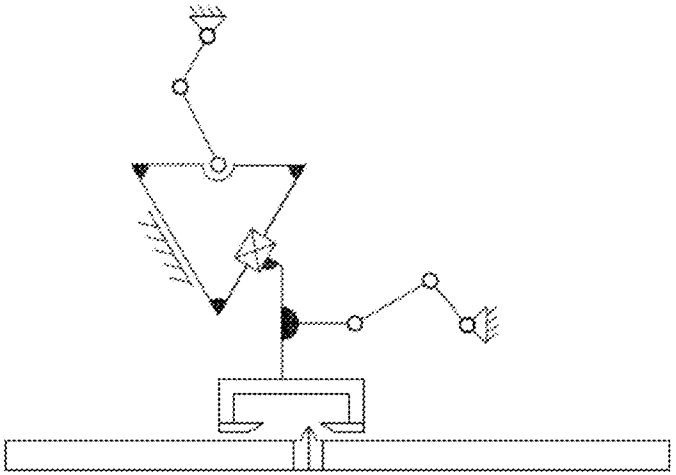
FIG. 4*b* shows a functional diagram of a high-precision heavy-load numerically-controlled flanging machine according to the present invention, a functional diagram of second embodiments.

One end of the connecting rod I is hinged with the crank I, the other end of the connecting rod I is hinged with the inertia block. In FIG. 3*b*, the connecting rod I is preferably hinged with a non-inclined plane (i.e., a plane except an upper inclined plane 421 and a lower inclined plane 422) of the inertia block. The working principle is shown in FIG. 4*b*.

In the above two embodiments, the transmission of the connecting rod of the crank-connecting rod mechanism I is preferably the following two driving methods.

Driving method I: the machine frame is preferably provided with a servo motor I configured for driving the crank I to rotate.

Driving method II: the transmission of the connecting rod of the crank-connecting rod mechanism I is driven by the toggle mechanism, which is specifically arranged as follows: the toggle mechanism is hinged at a hinge point where the crank I is hinged with the connecting rod I, and the hinge point is called a driving hinge point.

The toggle mechanism has the following three preferred embodiments.

Figure 18:
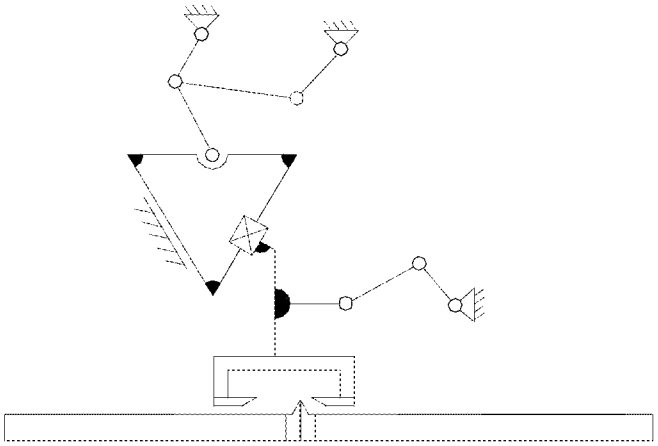
FIG. 18 shows a schematic diagram of a first embodiment of a toggle mechanism.

1. As shown in FIG. 18, the toggle mechanism is a third crank connecting mechanism comprising a crank III and a connecting rod III, wherein one end of the connecting rod III is hinged with the crank III, and the other end of the connecting rod III is hinged with the driving hinge point; the other end of the crank III is hinged on the machine frame and is connected with the servo motor I mounted on the machine frame.

Figure 19:
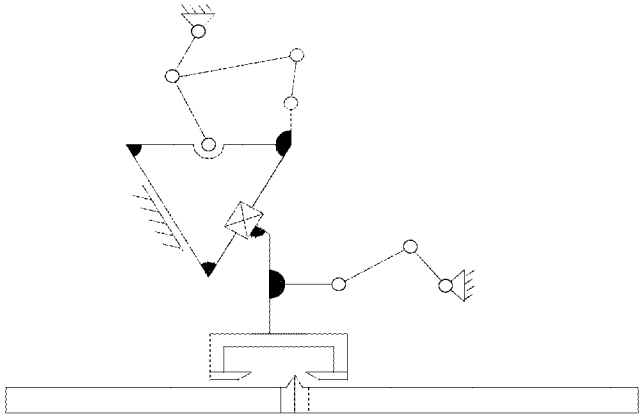
FIG. 19 shows a schematic diagram of a second embodiment of a toggle mechanism.

2. As shown in FIG. 19, the toggle mechanism is a third crank connecting mechanism comprising a crank III and a connecting rod III, wherein one end of the connecting rod III is hinged with the crank III, and the other end of the connecting rod III is hinged with the driving hinge point; the other end of the crank III is hinged on the inertia block and is connected with the servo motor I mounted on the inertia block.

Figure 20:
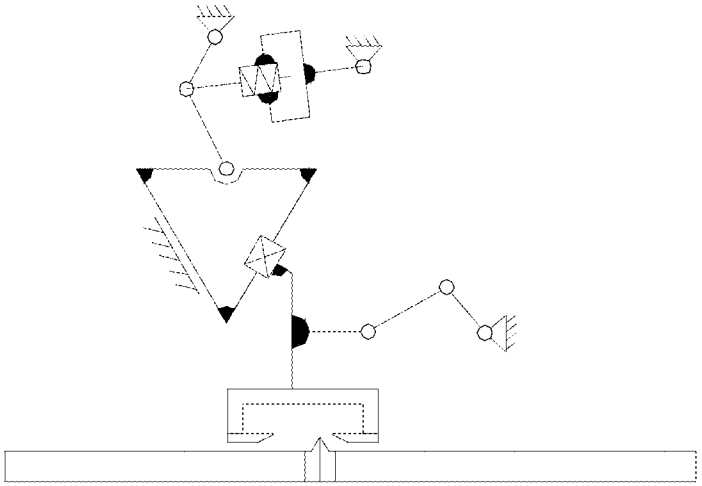
FIG. 20 shows a schematic diagram of a third embodiment of a toggle mechanism.

3. As shown in FIG. 20, the toggle mechanism is a lead screw transmission mechanism, wherein one end of a lead screw is hinged with the driving hinge point, the other end of the lead screw is connected in a lead screw base through a screw thread pair, the other end of the lead screw base is hinged on the machine frame, and the lead screw is driven to rotate by the servo motor I mounted on the machine frame.

As an alternative, the driving of the crank-connecting rod mechanism I may be the driving method that the servo motor drives the connecting rod I.

The crank-connecting rod mechanism I can be arranged behind the inertia block and can also be arranged above and below the inertia block, and the specific position is not limited.

The crank-connecting rod mechanism II comprises a crank II 442 and a connecting rod II 443 hinged with each other. The tail end of the crank II is preferably hinged on the machine frame through a fixing base 11441, and the machine frame is preferably provided with a servo motor II configured for driving the crank II to rotate.

The other end of the connecting rod II is preferably hinged with the horizontal beam.

In the present invention, the transmission of the connecting rod of the crank-connecting rod mechanism II can also be the two driving methods as those of the crank-connecting rod mechanism I. As an alternative, the driving of the crank-connecting rod mechanism may be the method that the servo motor drives the connecting rod II to move can also be adopted.

The crank-connecting rod mechanism II of the present invention can be arranged above or below the flanging beam, and the specific position is not limited.

The flanging die displacement detection mechanism is configured for detecting the coordinates of the flanging die, and preferably is two groups of grating rulers, and the movement displacement of the flanging beam in the horizontal direction and the vertical direction is fed back indirectly through the synthesis and operation of readings of the two groups of the grating rulers.

Each group of grating rulers comprises scale gratings, reading heads and displacement connecting rods.

Figure 8:
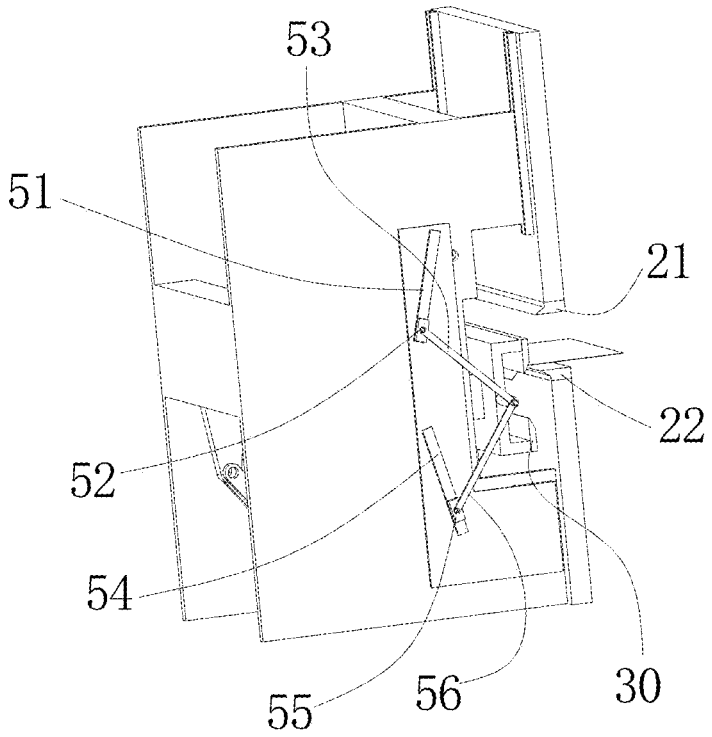
FIG. 8 shows a structural schematic diagram of two grating rulers mounted on a machine frame.

The two groups of grating rulers are a grating ruler I and a grating ruler II, respectively. As shown in FIG. 8, the grating ruler I comprises a scale grating 151, a reading head I 52 and a displacement connecting rod I 53; the grating ruler II comprises a scale grating 1154, a reading head 1155 and a displacement connecting rod 1156.

The scale grating I and the scale grating II are mounted on the machine frame, the reading head I is slidably connected in the scale grating I, the reading head II is slidably connected in the scale grating II, the displacement connecting rod I is configured for connecting the reading head with the flanging die, and the displacement connecting rod II is configured for connecting the reading head II with the flanging die.

As an alternative, the scale grating I and the scale grating II can also be arranged on the flanging beam, and the other ends of the displacement connecting rod I and the displacement connecting rod II are connected with the machine frame.

In the present invention, the precision and the rigidity of the flanging die can be improved, and the load of the sliding pair I and the sliding pair II can be alleviated by optimizing the inclination angles of two inclined planes of the inertia block, the positions of hinge points, the supporting positions and the connecting rod length of the crank-connecting rod mechanisms.

The present invention will be described in detail by taking the following three specific driving embodiments as examples.

Example 1. Simultaneous Movement in the Horizontal Direction (X Direction) and the Vertical Direction (Y Direction)

Figure 5A:
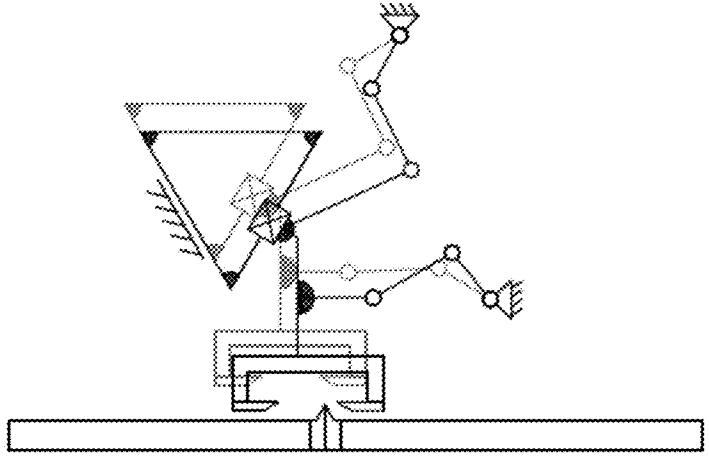
FIG. 5*a* shows a schematic diagram of position changes of two crank-connecting rod mechanisms according to the present invention when driving a flanging die in any degree of freedom, a schematic diagram of position changes of the first embodiment when driving the flanging die in any degree of freedom.
Figure 5B:
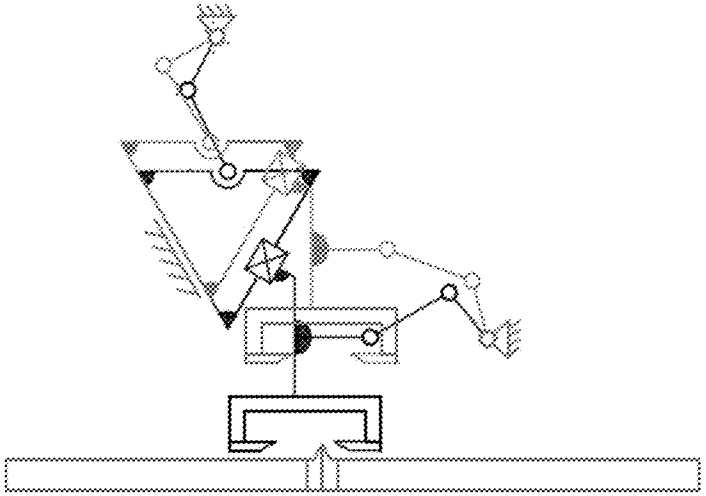
FIG. 5*b* shows a schematic diagram of position changes of two crank-connecting rod mechanisms according to the present invention when driving a flanging die in any degree of freedom, a schematic diagram of position changes of the second embodiment when driving the flanging die in any degree of freedom.

By the nonlinear coupling driving (composite driving) of the crank driving mechanism I and the crank driving mechanism II as shown in FIG. 5, the simultaneous movement in the horizontal direction and the vertical direction can be realized.

Figure 11:
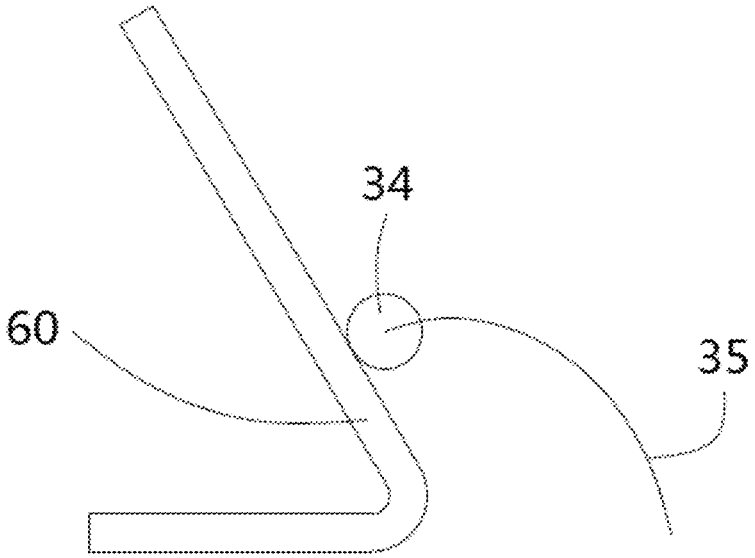
FIG. 11 shows a schematic diagram of a rolling orbit of a tool nose of a flanging die during bending.
Figure 12:
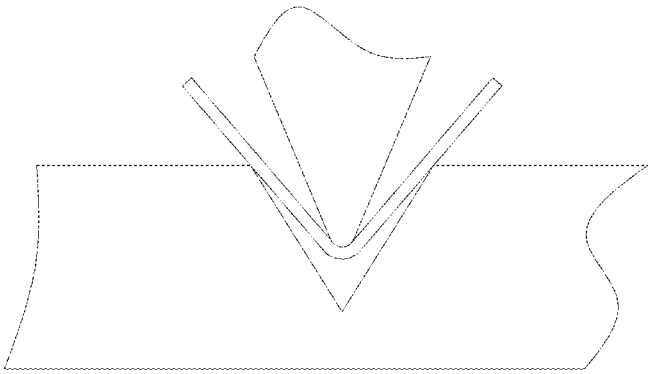
FIG. 12 shows a schematic diagram of "three-point" bending of plate bending equipment in the prior art.
Figure 13:
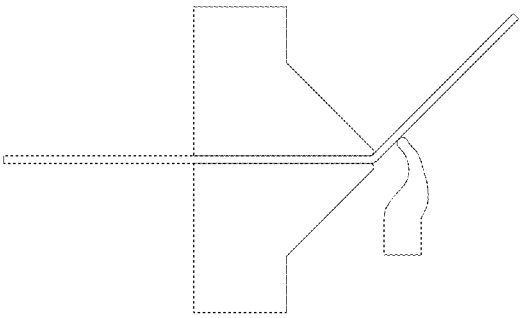
FIG. 13 shows a schematic diagram of flanging processing of a plate in the prior art.

In the process, due to the absence of additional swing, the movement orbit 35 of the tool nose of the flanging die can be controlled precisely on the XOY plane, as shown in FIG. 11. Therefore, when the tool nose 34 of the flanging die is contacted with the plate, the tool nose does not slide but only rolls relative to the plate in the bending process, and thus the indentation on the plate is avoided, so that the present invention is particularly suitable for the industries, such as household appliances and elevators, which has strict requirements on the indentation on the plate surface.

In the actual bending process, angle errors are inevitable. In this case, the movement displacement in the horizontal direction and the vertical direction of the flanging beam required by angle compensation can be calculated according to accurate mathematical operation for compensation and correction, and then the corresponding rotation angles of the crank I and the crank II are calculated through inverse kinematics solution, so that the bending precision is compensated. The whole process can be controlled automatically through a closed-loop control of "angle measurement—displacement calculation of the flanging beam—driving angle calculation of cranks I and II—real-time correction", that is, intelligent angle precision compensation.

The displacement of the flanging beam is fed back in real time by adopting a linear displacement feedback measuring device, such as a grating ruler, to form a closed-loop control. By the feedback of the grating ruler, the transmission part error, the temperature deformation and the elastic deformation of the structure can be compensated, and thus the precision is greatly increased.

Example 2. Movement in the Vertical Direction

Figure 6A:
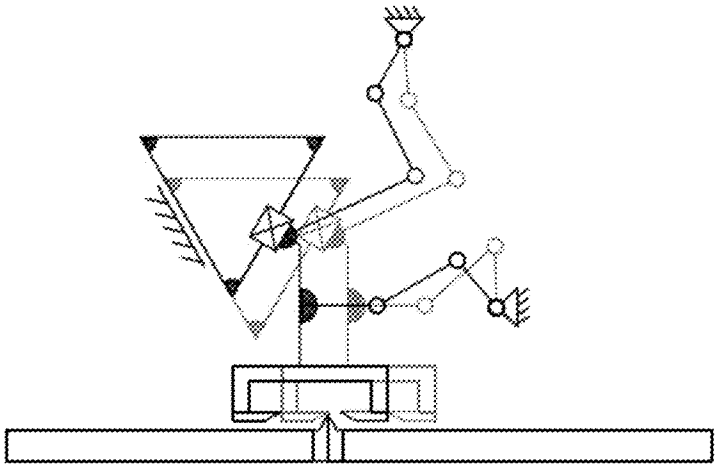
FIG. 6*a* shows a schematic diagram of position changes of two crank-connecting rod mechanisms according to the present invention when driving the translation of a flanging die in the vertical direction, a schematic diagram of position changes of the first embodiment when driving the translation of the flanging die in the vertical direction.
Figure 6B:
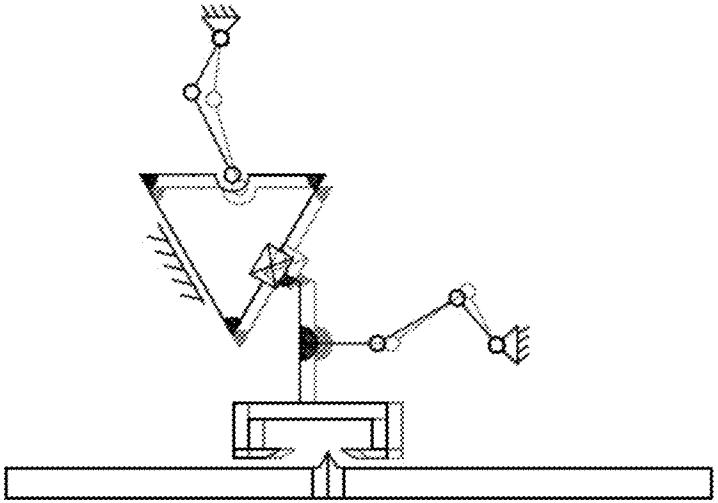
FIG. 6*b* shows a schematic diagram of position changes of two crank-connecting rod mechanisms according to the present invention when driving the translation of a flanging die in the vertical direction, a schematic diagram of position changes of the second embodiment when driving the translation of the flanging die in the vertical direction.

By the nonlinear coupling driving (composite driving) of the crank driving mechanism I and the crank driving mechanism II as shown in FIG. 6, the translation in the vertical direction can be realized.

Figure 9A:
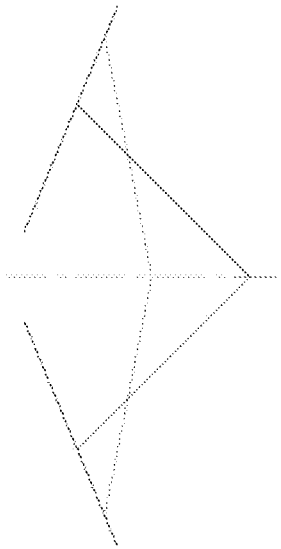
FIG. 9*a* shows a schematic diagram of resultant horizontal and vertical displacement changes of two gating rulers according to the present invention, a schematic diagram of a resultant horizontal displacement change of two gating rulers.
Figure 9B:
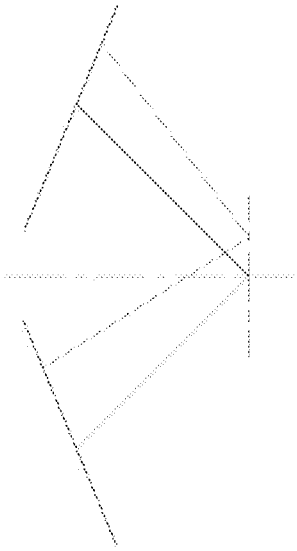
FIG. 9*b* shows a schematic diagram of resultant horizontal and vertical displacement changes of two gating rulers according to the present invention, a schematic diagram of a resultant vertical displacement change of two grating rulers.

In the process of translation in the vertical direction, the displacement X and the displacement Y of the flanging beam can be solved analytically through real-time readings of the two grating rulers. The displacement movement process of the two grating rulers is shown in FIG. 9*b*.

Example 3. Movement in the Horizontal Direction

Figure 7A:
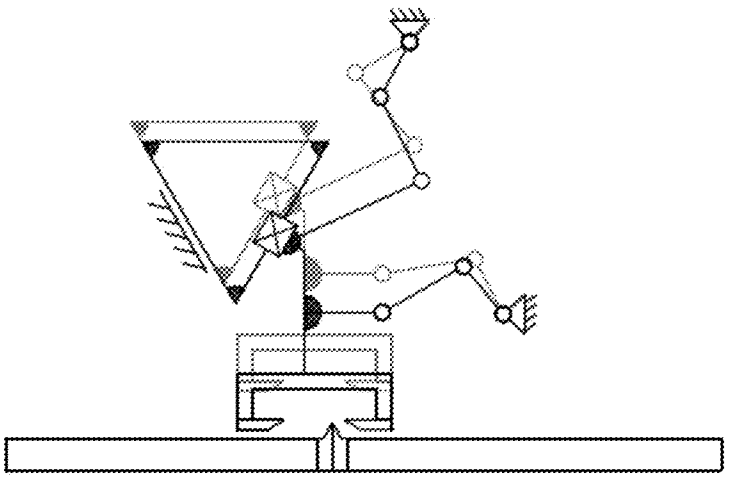
FIG. 7*a* shows a schematic diagram of position changes of two crank-connecting rod mechanisms according to the present invention when driving the translation of a flanging die in the horizontal direction, a schematic diagram of position changes of the first embodiment when driving the translation of the flanging die in the horizontal direction.
Figure 7B:
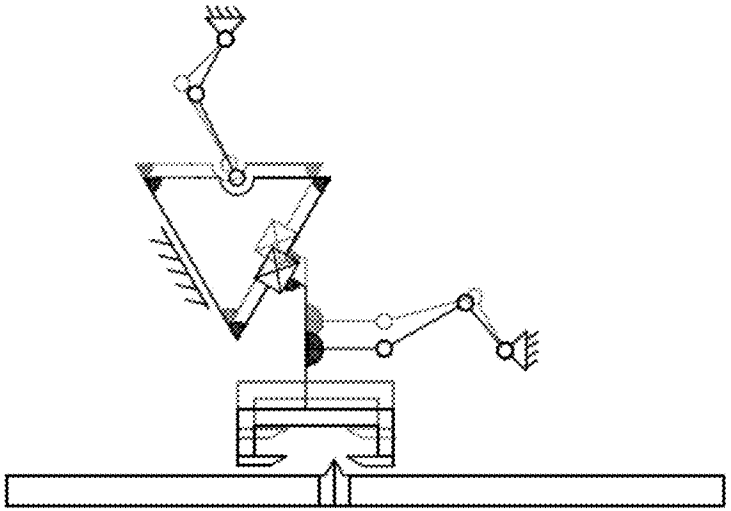
FIG. 7*b* shows a schematic diagram of position changes of two crank-connecting rod mechanisms according to the present invention when driving the translation of a flanging die in the horizontal direction, a schematic diagram of position changes of the second embodiment when driving the translation of the flanging die in the horizontal direction.

By the nonlinear coupling driving (composite driving) of the crank driving mechanism I and the crank driving mechanism II as shown in FIG. 7, the translation in the horizontal direction can be realized.

In the process of translation in the horizontal direction, the displacement X and the displacement Y of the flanging beam can be solved analytically through real-time readings of the two grating rulers. The displacement movement process of the two grating rulers is shown in FIG. 9*a*.

Figure 10:
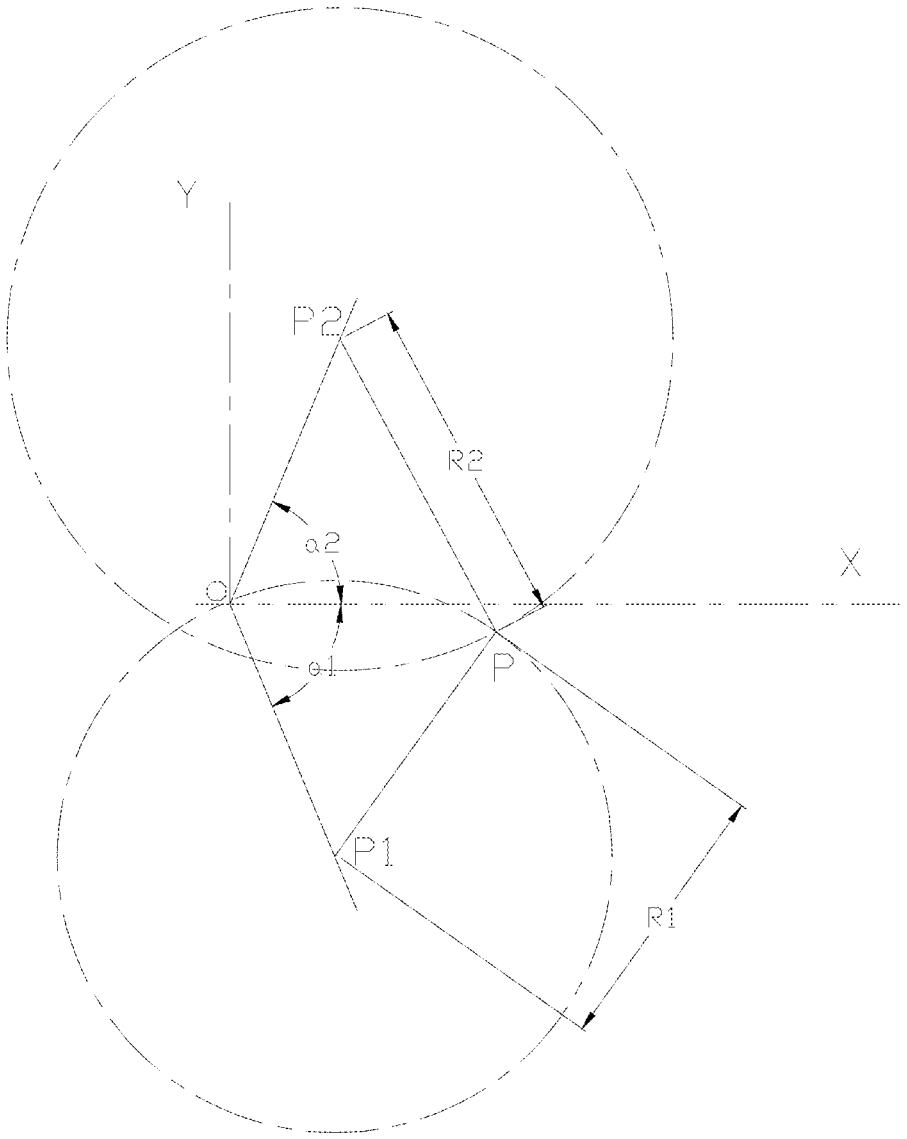
FIG. 10 shows a schematic diagram of a displacement solving process of a grating ruler.

As shown in FIG. 10, the method for solving the displacement of the flanging beam and the flanging die through the grating rulers comprises the following steps.

Step 1. Establishing a coordinate system and a linear equation of the grating rulers, comprising:

Step 11, establishing a coordinate system: establishing an XOY coordinate system by taking the horizontal direction as the X direction, the vertical direction as the Y direction and the intersection point of the two scale gratings as the origin O;

Step 12, establishing a linear equation 1 of the scale grating II:

$$y=K_1x$$

$$K_1=\tan(a1)$$

wherein, a1 is an included angle between the scale grating II and the X direction; the coordinate of the point of the reading head II on the linear equation 1 is P1 ($x_{p1}$, $y_{p1}$), and the distance between the point P1 and the origin O is $R_1$; the values of $x_{p1}$ and $y_{p1}$ are automatically read by the reading head II, and are known values;

Step 13, establishing a linear equation 2 of the scale grating I:

$$y=K_2x$$

$$K_2=\tan(a2)$$

wherein, a2 is an included angle between the scale grating I and the X direction; the coordinate of the point of the reading head I on the linear equation 2 is P2($x_{p2}$, $y_{p2}$), and the distance between the point P2 and the origin O is $R_2$; the values of $x_{p2}$ and $y_{p2}$ are automatically read by the reading head I, and are known values.

Step 2. Establishing a circle 1 with the radius being $R_1$: establishing a circle 1 with the point P1 as the center and the radius being $R_1$, wherein the equation of the circle 1 is:

$$(x-x_{p1})^2+(y-y_{p1})^2=R_1^2 \tag{1}$$

and expanding the equation of the circle 1 as:

$$x^2-2x_{p1}x+x_{p1}^2+y^2-2y_{p1}y+y_{p1}^2-R_1^2=0 \tag{2}$$

Step 3. Establishing a circle 2 with the radius being $R_2$: establishing a circle 2 with the point P2 as the center and the radius being $R_2$, wherein the equation of the circle 2 is:

$$(x-x_{p2})^2+(y-y_{p2})^2=R_2^2 \tag{3}$$

and expanding the equation of the circle 2 as:

$$x^2-2x_{p2}x+x_{p2}^2+y^2-2y_{p2}y+y_{p2}^2-R_2^2=0 \tag{4}$$

Step 4. Solving the coordinate of the point P ($x_p$, $y_p$) of the flanging beam and the flanging die: the coordinate of the point P ($x_p$, $y_p$) of the flanging beam and the flanging die is one of the intersection points of the circle 1 and the circle 2; $x_p$ and $y_p$, are solved as follows:

subtracting equation (2) from equation (4) to obtain the following difference equation of the intersection point:

$$y=-\frac{(x_{P1}-x_{P2})}{(y_{P1}-y_{P2})}x+\frac{(R_2^2-R_1^2+x_{P1}^2-x_{P2}^2+y_{P1}^2-y_{P2}^2)}{2(y_{P1}-y_{P2})} \tag{5}$$

setting:

$$K=-\frac{(x_{P1}-x_{P2})}{(y_{P1}-y_{P2})}$$

$$b=\frac{(R_2^2-R_1^2+x_{P1}^2-x_{P2}^2+y_{P1}^2-y_{P2}^2)}{2(y_{P1}-y_{P2})}$$

then, simplifying equation (5) to:

$$y=Kx+b \tag{6}$$

putting equation (6) into equation (1), and transforming to obtain:

$$(K^2+1)x^2+2(Kb-Ky_{p1}-x_{p1})x+(x_{p1}^2+b^2-2by_{p1}+y_{p1}^2-R_1^2)=0 \tag{7}$$

setting:

$$A=K^2+1$$

$$B=2(Kb-Ky_{p1}-x_{p1})$$

$$C=(x_{p1}^2+b^2-2by_{p1}+y_{p1}^2-R_1^2)$$

transforming equation (7) to obtain:

$$Ax^2+Bx+C=0 \tag{8}$$

solving the quadratic function of equation (8) to obtain an explicit solution of the X coordinate of the intersection point:

$$x_p = \frac{-B \pm \sqrt{B^2 - 4AC}}{2A} \tag{9}$$

then, putting equation (9) into equation (6) to obtain an explicit solution of the Y coordinate of the intersection point:

$$y_p=Kx_p+b \tag{10}$$

thus, acquiring all solutions for $x_p$ and $y_p$.

In the present invention, compared with the traditional lead screw transmission, the arrangement of the two crank-connecting rod mechanisms has the following advantages (mainly embodied in two aspects of bearing and noise).

1. The lead screw transmission is a linear transmission, the inverse kinematics solution is easy to solve, and the movement control is simple. But the design and manufacturing difficulty of the mechanical structure is increased, even leading to the failure of the mechanical design and manufacture, and the overall performance of the mechanism is reduced. However, the present invention is a nonlinear coupling mechanism, and the solving of the inverse kinematics solution is relatively complicated. Once the analytical solution is solved, the design and manufacturing difficulty of the mechanical structure can be greatly reduced, and the performance of the mechanism can be improved.

2. For a lead screw nut transmission mode, the fitting precision between the central line of a hinge revolute pair of a lead screw and the central line of a thread transmission pair is required to be very high and generally needs to be controlled at about 0.02 mm, which is difficult to achieve in actual production. If this precision requirement is not met, problems such as noise, vibration and shortened life are inevitable, and problems such as resonance will also occur. However, the nonlinear crank-connecting rod mechanisms of the present invention are all common conventional hinged constraints, which are small in manufacturing difficulty and easy to realize industrialization.

3. Due to the nonlinear characteristic of the mechanisms, the fast and low load output in a non-working stroke, and the slow and high load output in a working stroke, the pressure maintaining is facilitated at the end of the bending working stroke only by a smaller motor torque to improve the bending processing precision. However, the pressure maintaining of the linear lead screw mechanism will be performed by the peak motor torque, which will make the motor heat.

Figure 14:
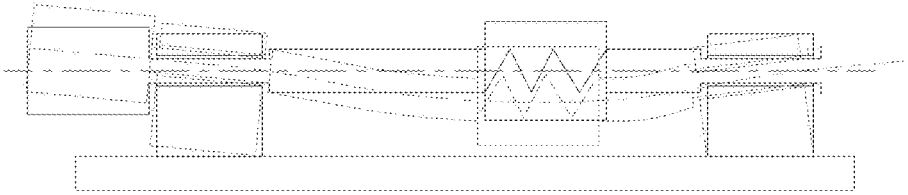
FIG. 14 shows a diagram of stress deformation of a lead screw under heavy load when the lead screw is adopted in a transmission mechanism according to the present invention.

4. When the lead screw bears heavy load, as the hinge point and the screw thread pair of the lead screw are not strictly symmetrical, and the connection rigidity of the lead screw and a structural part is poor, the lead screw can generate bending deformation as shown in FIG. 14 under stress, and the service life is influenced. However, the present invention does not have this problem.

5. The present invention has the nonlinear characteristic, which is very suitable for bending working condition, and has the fast and low load output in a non-working stroke, and the slow and high load output in a working stroke.

6. When the connecting rod I of the crank-connecting rod mechanism I is hinged with the flanging beam, the bending load is directly transmitted to the machine frame through the crank-connecting rod mechanism I, and the sliding pair only needs to bear a very small load (only needs to bear the overturning load caused by the load center not being in a straight line with the hinge center, which is actually much smaller than the bending working load), so that heavy-load large-tonnage bending can be realized.

When the connecting rod of the crank-connecting rod mechanism I is hinged with the flanging beam, the inverse kinematics solution of the flanging beam driving mechanism is simpler, the analytical solution is easier to solve, and the high-speed high-precision control is facilitated.

Assuming that, in general, the speed of the total stroke is about 200 mm/s, the idle stroke is 190 mm, the bending stroke is 5 mm (upper and lower ends), the bending speed is 8 mm/s (not greatly affecting the efficiency), and the maximum speed is 200 mm/s: assuming that a required bending load is 150000 N, the time for both mechanisms to travel the total stroke at the highest speed is equal as 1 s.

For a linear transmission mechanism of a ball screw, the power required by a motor is as follows: P=0.2 m/s·150000 N=30000 W=30 kW.

Figure 15:
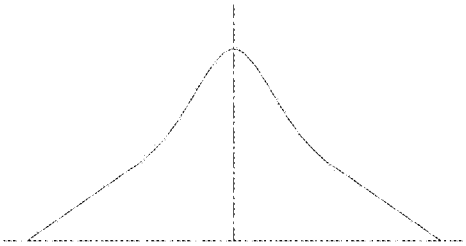
FIG. 15 shows a speed-position curve of a transmission mechanism according to the present invention.
Figure 16:
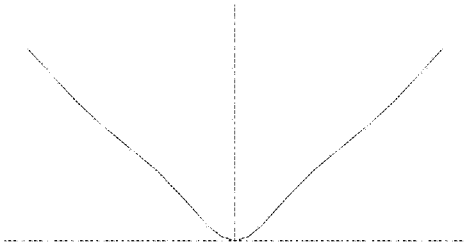
FIG. 16 shows a force-position curve of a transmission mechanism according to the present invention.
Figure 17:
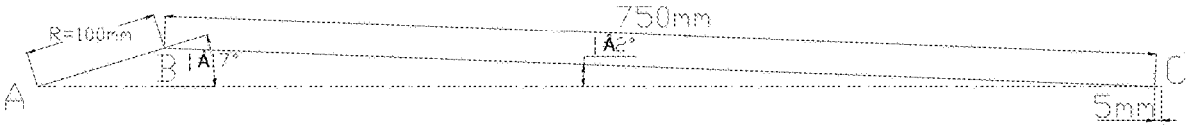
FIG. 17 shows a schematic diagram of crank-connecting rod mechanisms according to the present invention moving to a certain position.

After a nonlinear crank-connecting rod transmission mechanism of the present invention is adopted, a speed-position curve, a force-position curve and a schematic diagram of the crank-connecting rod mechanism moving to a certain specific position are shown in FIGS. 15, 16 and 17, respectively.

In the crank-connecting rod mechanism, assuming that a hinge point between the crank and the machine frame is A, a hinge point between the crank and the connecting rod is B, and a hinge point between the connecting rod and the inertia block or the flanging beam is C, a schematic diagram of the crank-connecting rod mechanism moving to a certain specific position is shown in FIG. 17. In the figure, $\alpha=17°$ is an inclined angle between the crank and an auxiliary straight line AC, $\beta=2°$ is an inclined angle between the connecting rod and the auxiliary straight line AC, R=100 m is a length of the crank, 750 mm is a length of the connecting rod, and 5 mm is a distance of the bending working stroke.

The output torque of the servo motor I or the servo motor II is as follows:

$$M=F\cdot R\cdot\sin(\alpha+\beta)=150000\cdot 0.1\cdot\sin(19°)=4883.5\ \text{Nm}$$

wherein, F is the bending load, and R is the length of the crank: 100 mm, i.e., 0.1 m.

The angular speed is as follows:

$$\omega = \frac{\pi}{1} = 3.14\ \text{rad/s}$$

then the output power of the servo motor I or the servo motor II is as follows:

$$P=M\cdot\omega=4883.5\ \text{Nm}\cdot 3.14\ \text{rad/s}=15334\ \text{W}\approx 15\ \text{kW}.$$

Therefore, compared with a linear transmission mode of a ball screw, the motor driving power of present invention is reduced by about 50%, and the effects of energy saving and cost reduction are very obvious.

Although the preferred embodiments of the present invention have been described in detail, the present invention is not limited to the details of the embodiments. Various equivalent changes may be made within the technical concept of the present invention, and these equivalent changes are within the technical scope of the present invention.

What is claimed is:

1. A high-precision heavy-load numerically-controlled flanging machine, comprising a machine frame, an edge pressing assembly, a flanging beam, a flanging beam driving mechanism and a flanging die, wherein the edge pressing assembly is configured for pressing the edge of a plate, the flanging die is mounted on the flanging beam, and the flanging beam is configured to be driven by the flanging beam driving mechanism to move up-and-down and left-and-right; the flanging beam driving mechanism comprises an inclined slide rail, an inertia block and two crank-connecting rod mechanisms; the flanging beam is provided with a driving inclined plane; the inclined slide rail is obliquely mounted on the machine frame; the inertia block is provided with two non-parallel inclined planes, wherein one of the two non-parallel inclined plane of the inertia block is slidably mounted on the inclined slide rail to form a sliding pair I, and the other of the two non-parallel inclined plane of the inertia block is in sliding fit with the driving inclined plane of the flanging beam to form a sliding pair II; cranks of the two crank-connecting rod mechanisms are hinged on the machine frame, wherein a connecting rod of one of the two crank-connecting rod mechanism is hinged with the flanging beam or the inertia block, and a connecting rod of the other of the two crank-connecting rod mechanism is hinged with the flanging beam, and the high-precision heavy-load numerically-controlled flanging machine further comprising a toggle mechanism configured for driving the crank-connecting rod mechanism connected with the inertia block, the toggle mechanism being a third crank-connecting rod mechanism or a lead screw transmission mechanism.

2. The high-precision heavy-load numerically-controlled flanging machine according to claim 1, further comprising a flanging die displacement detection mechanism configured for detecting the coordinates of the flanging die.

3. The high-precision heavy-load numerically-controlled flanging machine according to claim 2, wherein the flanging die displacement detection mechanism is a grating ruler comprising a scale grating, a reading head and a displacement connecting rod; wherein the scale grating is mounted on the machine frame or the flanging beam, the reading head is slidably connected on the scale grating, and the displacement connecting rod is configured for connecting the reading head with the flanging beam or connecting the reading head with the machine frame.

4. The high-precision heavy-load numerically-controlled flanging machine according to claim 3, wherein two of the grating rulers are provided, and the movement displacement of the flanging beam in the horizontal direction and the vertical direction is fed back indirectly through the synthesis and operation of readings of the two of the grating rulers.

5. The high-precision heavy-load numerically-controlled flanging machine according to claim 1, wherein the inertia block is L-shaped, triangular, trapezoidal, quadrilateral or wedge-shaped.

6. The high-precision heavy-load numerically-controlled flanging machine according to claim 1 or 5, wherein the flanging beam comprises a C-shaped notch and a horizontal beam; the flanging die is mounted at the opening of the C-shaped notch, one end of the horizontal beam is connected with the C-shaped notch, and the other end of the horizontal beam is provided with the driving inclined plane.

7. The high-precision heavy-load numerically-controlled flanging machine according to claim 6, wherein the two crank-connecting rod mechanisms are a crank-connecting rod mechanism I and a crank-connecting rod mechanism II, respectively; wherein the crank-connecting rod mechanism I comprises a crank I and a connecting rod I hinged with each other; the tail end of the crank I is hinged on the machine frame, and the other end of the connecting rod I is hinged with the flanging beam or the inertia block;

the crank-connecting rod mechanism II comprises a crank II and a connecting rod II hinged with each other; the tail end of the crank II is hinged on the machine frame, and the other end of the connecting rod II is hinged with the flanging beam.

8. The high-precision heavy-load numerically-controlled flanging machine according to claim 7, wherein the precision and the rigidity of the flanging die can be improved, and the load of the sliding pair I and the sliding pair II can be alleviated by optimizing the inclination angles of two inclined planes of the inertia block, the positions of hinge points, the supporting positions and the connecting rod length of the crank-connecting rod mechanisms.

9. The high-precision heavy-load numerically-controlled flanging machine according to claim 1, wherein the included angle between the sliding pair I and a horizontal plane is between −75° and +75°; the included angle between the sliding pair II and a vertical plane is between −75° and +75°.

* * * * *